US005080238A

United States Patent [19]

Hochman

[11] Patent Number: 5,080,238

[45] Date of Patent: Jan. 14, 1992

[54] DISPLAY HOOK SYSTEM

[76] Inventor: Arthur Hochman, 449 Holiday Dr., Hallendale, Fla. 33009

[21] Appl. No.: 512,144

[22] Filed: Apr. 20, 1990

[51] Int. Cl.[5] ..... A47F 5/00

[52] U.S. Cl. ..... 211/59.1; 211/87; 248/220.4

[58] Field of Search ..... 211/59.1, 57.1, 94, 211/87, 54.1, 193; 248/220.4, 220.3, 221.1, 222.4, 222.2

[56] References Cited

U.S. PATENT DOCUMENTS

| | | | |
|---|---|---|---|
| 4,018,341 | 4/1977 | Jarecki | 211/59.1 |
| 4,362,249 | 12/1982 | Thalenfeld | 211/59.1 |
| 4,389,133 | 6/1983 | Oberst | 248/222.4 X |
| 4,436,209 | 3/1984 | Thalenfeld | 211/59.1 X |
| 4,632,256 | 12/1986 | Gambello | 248/220.4 X |
| 4,726,554 | 2/1988 | Sorrell | 211/59.1 X |
| 4,750,698 | 6/1988 | Barnes | 211/59.1 X |
| 4,869,376 | 9/1989 | Valiulis et al. | 211/59.1 |
| 4,882,868 | 11/1989 | Fast | 211/59.1 X |
| 4,905,846 | 3/1990 | Calvert | 211/59.1 |

*Primary Examiner*—Blair M. Johnson
*Attorney, Agent, or Firm*—Robert C. Kain, Jr.

[57] ABSTRACT

In one embodiment, the display hook system permits merchandise to be hung off a vertical surface such as a pegboard surface. The system includes a keeper having legs which extend outboard from a planar back surface of the keeper and through and behind the pegboard surface. The keeper includes a slotted front end keyway and a back surface which is adjacent the pegboard surface when the keeper is mounted on the pegboard. The system also includes, in one embodiment, vertically spaced apart upper and lower extension rods that are affixed integral with a base. The base forms a key complementary to the slotted keyway of the keeper. The key is vertically insertable into the keyway such that the upper and lower extension rods extend outboard through the slot when the base is mounted on the keeper. The base further includes an anti-rotation tab on its top surface such that after insertion of the key into the keyway, the tab abuts the pegboard surface and prevents upward rotational movement of the keeper, the base and the extension rods.

25 Claims, 2 Drawing Sheets

DISPLAY HOOK SYSTEM

BACKGROUND OF THE INVENTION

The present invention relates to a display hook system for hanging merchandise off of a vertical surface and a method for the same.

With labor costs continually rising, it is no longer feasible to mark prices on each piece of merchandise or item that is sold in retail stores and outlets. Accordingly, almost all merchandise is marked with a bar code or optical scanning code based upon the uniform product code (UPC) which can be read by optically or electronically scanning devices such as cash registers and inventory control devices. The bar code is transformed into information relating to the product such as the product name, price, etc. and, at the point of purchase this information is used to generate a customer receipt. This business system reduces the chance of error at the checkout and also permits continuous gathering and reporting of inventory data for the merchandise sold by the retail outlet. With respect to inventory control devices, the bar code permits an inventory to be rapidly taken by an operator at the point of product display.

Since the products or merchandise do not bear a label containing the price of the merchandise (due to the bar code data displayed on the merchandise), it is important to display the price of the merchandise on the display system or vehicle carrying the merchandise at the product display point. A label or sign bearing the price, description of the merchandise, and bar code is customarily placed on the display system. This label at the point of display permits store personnel to scan the bar code by a portable scanner thereby permitting an inventory to be taken of all the merchandise in the store.

Various display systems have been developed in the past. U.S. Pat. No. 4,066,169 to Hochman discloses a slide down body 22 with a lower surface having a groove therein to accommodate a wire 32 angularly extending outboard from a vertical surface. Wire 32 has a curved end close which fits into the pegboard. The slide down body prevents the upward rotation of the wire due to the abutment of the body atop the wire in the region adjacent the pegboard. To remove this display system, the slide down body must be moved vertically upward beyond the wire and the wire must be rotated through an arc such that the remote end of the wire, remote from the pegboard, rotates toward the pegboard such that the wire clip is withdrawn from the pegboard hole. In another embodiment, a keeper is mounted onto the pegboard and the keeper has a vertical through passage into which is placed one leg of the wire. A slide down body is then placed over the wire. To remove this display system from the wall, the slide down body must first be lifted from the wire, the wire must then be withdrawn from the vertical through passage of the keeper, and then the keeper must be rotated through an arc to withdraw the keeper legs from the pegboard. U.S. Pat. No. 4,351,440 to Thalenfeld discloses a different display system. This system includes a pivoting lug plate that has legs extending through and beyond a pegboard surface. A cross bar is welded to the base of a wire extension. The cross bar is normal to the axial center line of the wire extension on which the merchandise is hung. To remove this display system from the pegboard, the lug is rotated arcuately and the system is horizontally withdrawn from the pegboard. At the distal end of one of the extension wires, remote from the pegboard, a removable information/display surface is attached to the wire. This display surface protects and covers both the top extension wire and the lower extension wire.

U.S. Pat. No. 4,474,351 to Thalenfeld discloses another display system. In this system, a base has back hooks which extend through a pegboard. The upper and lower extension wires are welded to a cross piece normal to the axial center line of both extension wires. The cross piece is held by the base in recesses that are spaced substantially forward of the back wall or pegboard. To remove this display system, the cross piece must be withdrawn from the recesses of the base and then the base is arcuately rotated to withdraw the back hooks from the pegboard. U.S. Pat. No. 4,436,209 to Thalenfeld discloses another display system. A cross bar is attached to the proximal end of the extension wire and is held in recesses spaced from the pegboard surface. In order to remove this display system, a tab on the base, defining the recesses, is rotated thereby withdrawing the back hooks of the base from behind the pegboard. The depending end of the extension wire proximate the pegboard surfaces moves along the pegboard due to the arcuate rotation of the base because the cross piece is rotatably held in the recesses. U.S. Pat. No. 4,674,721 to Thalenfeld; U.S. Pat. No. 4,718,626 to Thalenfeld et al.; U.S. Pat. No. 4,405,051 to Thalenfeld; and U.S. Pat. No. 4,114,763 to Hochman show other display systems.

One of the problems with the aforementioned display systems is that it may be necessary to require removable of vertically adjacent shelves or obstructions, that is, obstructions immediately above the display systems, in order to mount the display system onto the vertical wall. Typically, the vertical wall is a pegboard, slat wall, or other type surface. Some of these display systems require a very large vertical area in which the display system can be rotated in order to mount the system to the vertical surface. A further problem with some of the aforementioned display systems is that the extending wires or rods can be accidentally or unintentionally removed from the vertical surface. Particularly, if the outboard or distal end of the extension wire is rotated arcuately, the base may accidentally be withdrawn from the pegboard or vertical surface. A further problem with some of these display systems is that they lack any type of shield for reducing the possibility that the distal ends of the extension rods or wires may accidentally injure a customer in the store due to the protruding nature of the extension wire.

OBJECTS OF THE INVENTION

It is an object of the present invention to provide a display system wherein the keeper or base can be mounted to the vertical wall surface and any size rod extensions or bars can be mounted into the keeper for hanging or retaining merchandise.

It is another object of the present invention to provide a display system which can be mounted vertically immediately below a shelf or other vertical obstruction without having to remove the shelf or obstacle.

It is a further object of the present invention to provide a display system which can be mounted onto the vertical surface without having to rotate the entire device arcuately with respect to the pegboard surface. Accordingly, a relatively small vertical clearance must be provided to enable the display system to be mounted to the vertical surface.

It is an additional object of the present invention to provide a display system wherein the system itself cannot be rotated arcuately due to a rotation block device in the system.

It is another object of the present invention is to provide a display surface to hold pricing and bar code data which is integral with the extension rods. Accordingly, the present system prohibits the display surface and its information from being accidentally or deliberately removed from the extension rods and hence the display system.

It is a further object of the present invention to provide a display system wherein the display surface is integral such that the surface cannot be removed and hence the surface can be configured to provide a shield for both the upper and lower extension rods.

SUMMARY OF THE INVENTION

In one embodiment, the display hook system permits merchandise to be hung off a vertical surface such as a pegboard surface. The system includes a keeper having legs which extend outboard from a planar back surface of the keeper and through and behind the pegboard surface. The keeper includes a slotted front end keyway and a back surface which is adjacent the pegboard surface when the keeper is mounted on the pegboard. The system also includes, in one embodiment, vertically spaced apart upper and lower extension rods that are affixed integral with a base. The base forms a key complementary to the slotted keyway of the keeper. The key is vertically insertable into the keyway such that the upper and lower extension rods extend outboard through the slot when the base is mounted on the keeper. The base further includes an anti-rotation tab on its top surface such that after insertion of the key into the keyway, the tab abuts the pegboard surface and prevents upward rotational movement of the keeper, the base and the extension rods.

BRIEF DESCRIPTION OF THE DRAWINGS

Further objects and advantages of the present invention can be found in the detailed description of the preferred embodiments when taken in conjunction with the accompanying drawings in which.

DETAILED DESCRIPTION OF THE PREFERRED EMBODIMENTS

The present invention relates to a display hook system for hanging merchandise off of a vertical surface and a method therefor.

Figures 1, 2, 3, 4:
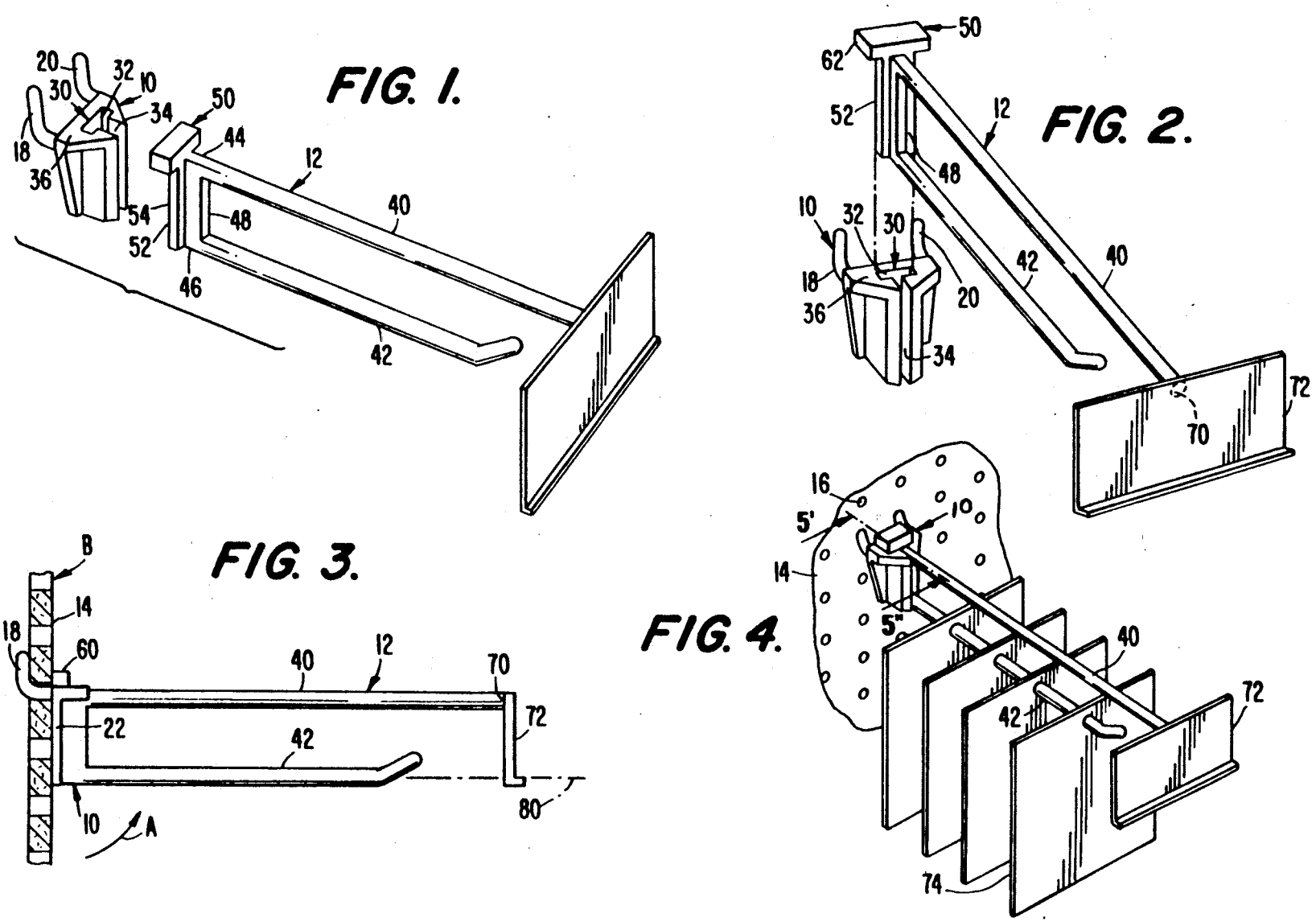
FIG. 1 illustrates a perspective view of one embodiment of the invention, a keeper, extension rods, a base and a display surface, in accordance with the principles of the present invention.
FIG. 2 illustrates a perspective view of the keeper, extension rods, base and display surface immediately prior to vertical insertion of the key into the keyway.
FIG. 3 illustrates a side view of the embodiment of the invention shown in FIGS. 1 and 2 after being mounted onto vertical pegboard surface.
FIG. 4 is a perspective view of the embodiment illustrated in FIGS. 1 and 2 mounted on the pegboard with merchandise hanging from the lower extension rod.
Figure 5:
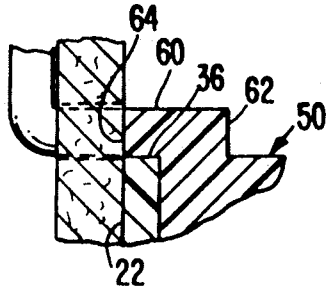
FIG. 5 is a broken away, detailed, cross-sectional view of portions of the keeper and the anti-rotation tab on the base.

FIG. 1 illustrates a perspective view of one embodiment of the display hook system which includes a keeper 10 and a display hook body 12. FIG. 2 is another perspective view of the display hook system; FIG. 3 is a side elevational view of the system with display hook body 12 inserted into keeper 10 and the keeper being mounted onto a pegboard surface 14; FIG. 4 is a further perspective view of the system with merchandise hanging from a lower extension rod; and FIG. 5 is a detail, broken away, cross-sectional view of a portion of the keeper and proximal end of the display hook body from the perspective of section line 5'-5" in FIG. 4. FIGS. 1-5 will be referred to concurrently herein.

In the embodiment illustrated in FIGS. 1-5, keeper 10 is adapted to be mounted onto a pegboard surface 14. Pegboard 14 has a plurality of holes one of which is identified as hole 16 in FIG. 4. Keeper 10 has pegboard insertion legs 18 and 20 which are adapted to be inserted into pegboard 14. Keeper 10 has a planar back surface 22 (FIGS. 3 and 5) and legs 18 and 20 extend outboard from keeper back surface 22 or away from the principal portions of the body of keeper 10. Legs 18 and 20 define a smooth, 90° upward curve with respect to the principal portions of the keeper body. When inserted into a pegboard, legs 18 and 20 extend through the pegboard surface and behind the pegboard surface such that keeper 10 is vertically mounted onto the pegboard surface. In order to insert or withdraw keeper 10 from the pegboard surface, the keeper must be rotated in an arc as generally depicted by the arrow at the end of curved line A in FIG. 3.

Keeper body 10 also includes a slotted, front end keyway generally identified as keyway 30. Keyway 30 includes a T-shaped keyway 32 wherein the top of the T-shaped keyway is spaced from but is substantially parallel to back surface 22 as well as vertical surface or pegboard surface 14. Keyway 30 also includes a front end slot 34 that is the base or leg of the T-shaped keyway 32. Slot 34 extends the height of keeper 10 and provides a vertical passage for the insertion of an outboard extension of display hook body 22 which is adapted to hang merchandise thereon. Keeper 10 also includes a flat top surface 36 that is normal to keeper backside 22 (FIG. 5). T-shaped keyway 32 extends the height of keeper 10.

Display hook body 12 includes, in this embodiment, an upper extension rod 40 and a lower extension rod 42. The proximal ends 44 and 46, those ends adapted to be disposed closest to the keeper and hence the vertical surface of the pegboard, are joined together by an outboard or outwardly extending base extension 48. In addition, extension rods 40 and 42 adjoin a base generally identified as base 50. As explained later, all parts of display body 12 are integral. Base 50 forms a key 52 which is complementary to the slotted keyway 30 of keeper 10. In this embodiment, key 52 forms a solid T-shaped key with a solid, key top 54 and a solid T-leg formed by outboard base extension 48. The top of the key 54 is adapted to slide vertically into keyway region 32 (FIG. 2), and outboard base extension 48 is adapted to closely fit within front end slot 34. Effectively, key 52 is vertically inserted to keyway 30. Due to the elongated slot defined by keeper 10, and the close interference fit between the walls of slot 34 and outboard base extension 48, display hook body 12 is securely fastened within keeper 10 and cannot move laterally with respect to keeper 10 when keeper 10 is mounted on pegboard 14. The T-shaped slot 32, and particularly the top of keyway 32, in cooperation with solid T-top 52, prohibits outboard movement of display hook body 12 away from pegboard 14.

Most importantly, and with reference to FIG. 5, base 50 includes an anti-rotation tab 60 that, in this embodiment, is part of a top cap 62 (FIGS. 2 and 5) that rests atop and abuts keeper top surface 36 (FIG. 5). Anti-rotation tab 60 includes back surface 64 that abuts the surface of pegboard 14. Since tab 60 extends above and beyond keeper top surface 36, and also abuts the pegboard surface, upward rotational or arcuate movement of display hook body 12 is prohibited due to the locking action of the key in the keyway and the blocking action of tab 60 against the surface of pegboard 14.

At the distal or remote end 70 of upper extension rod 40, a planar display surface 72 is mounted. See FIGS. 2 and 3. Display surface 72 is a mounting surface for bar code and human readable pricing and product information for merchandise such as merchandise 74 from lower extension rod 42 in FIG. 4. Also, extension rod 42 is shorter than extension rod 40, is vertically spaced below extension rod 40 and display surface 72 is sized such that an imaginary line 80 in FIG. 3 coaxial with the axial center line of lower rod 42 passes through display surface 72. By correctly spacing the upper and lower extension rods 40 and 42 and providing a suitably sized display surface 72, display surface 72 acts as a guard or shield to reduce the possibilities of injury to customers due to the protruding aspects of lower extension rod 42.

Most importantly, all portions of display hook body 12 are integral and are preferably made of an engineering grade, thermal plastic sold under the trademark CELCON. Keeper 10 is preferably made of the same thermal plastic. The entire display system has a significant amount of strength yet is very light weight. The system can be molded incorporating a range of colors to suit any type of store interior or package design.

Since display surface 72 is completely integral with extension rod 40, display surface 72 cannot be removed either deliberately or accidentally. This provides an additional safety feature that is not readily apparent from the prior art discussed earlier. Accordingly, the present display hook system is safer and is designed to carry the human readable information at all times. Further, the length of display hook body 12 is not limited in any sense with respect to keeper 10. Accordingly, different size display hook bodies can be inserted into one standardized keeper. Also, in order to mount the display hook system onto a vertical surface, keeper 10 is first mounted on the surface by arcuate motion and then display hook body 12 is vertically inserted into the keeper. Accordingly, a minimal vertical distance is required to mount the keeper, due to its short arcuate length and also only the height of base 50 must be available between the mounted keeper and an obstruction such as a shelf vertically atop the keeper in order to mount display body 12. For example, a shelf may be located at point B on pegboard 14 and still the display hook system could be mounted onto the wall by simply rotating keeper body and peg insertion legs into the wall and then vertically sliding display hook body 12 into the keeper body. This ease of assembly, and also disassembly, is beneficial in any retail establishment.

Figure 6:
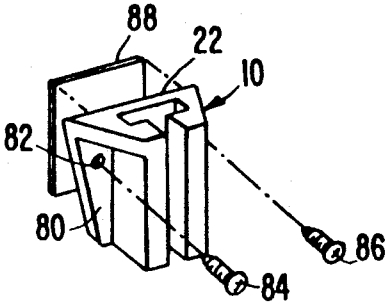
FIG. 6 illustrates a perspective view of another mounting system for mounting the keeper onto a vertical surface.

FIG. 6 shows an alternate embodiment of keeper 10 wherein the side flanges of the keeper, one of which is flange 80, includes holes, one of which is hole 82, through which passes screw mounts 84 and 86. In order to facilitate the attachment of keeper 10 onto a vertical surface, a double sided, self-adhesive stick pad 88 is utilized between the vertical surface and backside 22 of keeper 10. After adhering keeper 10 to the vertical surface using double sided adhesive pad 88, screw mounts 84 and 86 are utilized to mount keeper 10 securely on the vertical surface.

Figure 7:
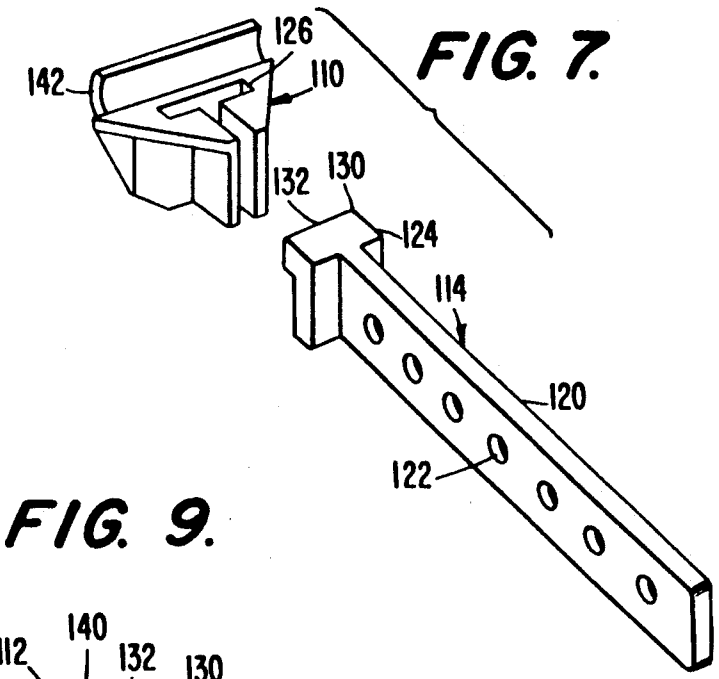
FIG. 7 is a perspective view of further embodiments of the present invention utilizing first, a single extension bar and, second, a slat wall keeper.
Figure 9:
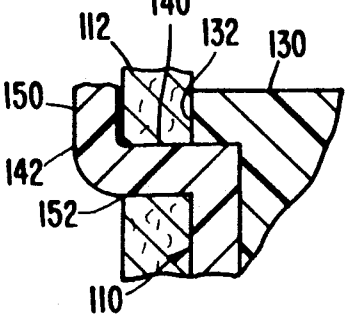
FIG. 9 is a partial, detail, broken away view of the keeper, slat wall, and anti-rotation tab from the perspective of section line 9'-9" in FIG. 8.
Figure 8:
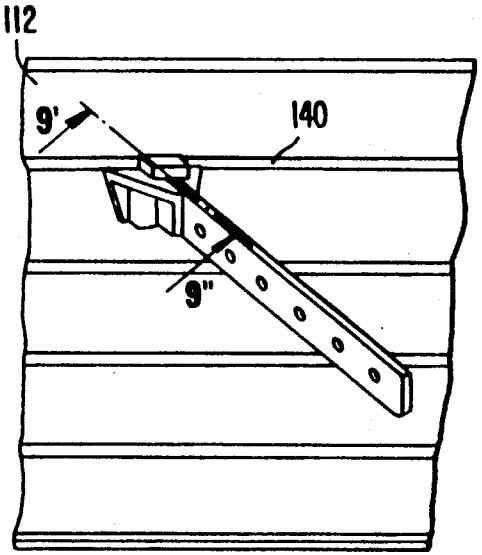
FIG. 8 is a perspective view of the embodiment illustrated in FIG. 7 with the system mounted on the slat wall.

FIGS. 7, 8 and 9 show other embodiments of the present invention both with respect to keeper 110 being adapted to be mounted onto a slat wall 112 and with respect to an outboard extension bar 114 which can be utilized in place of the dual rod display hook system shown in FIGS. 1–5. FIG. 7 is a perspective view of the alternate embodiments, FIG. 8 is a perspective view of these alternate embodiments mounted on a slat wall, and FIG. 9 is a detail, broken away cross-sectional view from the perspective of section line 9'–9" in FIG. 8. All of these figures will be referred to concurrently herein.

One alternate embodiment shown in FIG. 7 is a single outboard extension that is a generally solid bar 120 with a plurality of horizontal holes, one of which is hole 122, therethrough. Base 124 is configured as a key which is complementary to keyway 126, as described earlier. Further, base 124 includes an anti-rotation tab 130 that has a backside surface 132 (FIG. 9) that abuts the wall vertical surface. In other words, single bar 120 could be substituted for display hook body 12 in FIGS. 1–5 by simply removing display hook body 12 and replacing it with body 114.

The other embodiment shown in FIGS. 7 and 8 is a slat wall keeper 110 adapted to be mounted onto slat wall 112. Slat wall 112 includes a plurality of horizontal slat openings, one of which is slat opening 140. As is known in the art, slat wall 140 leads to a vertical channel behind the slat wall vertical surface. Keeper 110 (FIG. 7) includes a curved lip 142 that defines a smooth, 90° upward curve with respect to the principal portions of keeper 110. See FIG. 9. To mount keeper 110 on slat wall 112, the keeper is first horizontally disposed such that the upper portions of the lip 150 (FIG. 9) pass through slat 140 and then the keeper is rotated through an arc such that lip base 152 is positioned in slat opening 140. Thereafter, a display hook body, such as body 114 or body 12, is vertically inserted and mounted on keeper 110 by inserting the key of base 124 ( or base 50) into keyway 126. Anti-rotation tab 130 abuts slat wall 112 in a region above keeper 110 (FIG. 9) and prevents the outboard extension (bar 120) from rotating upward with respect to slat wall 112.

The claims appended hereto are meant to cover modifications and changes within the spirit and scope of the present invention.

What is claimed is:

1. A display hook system for hanging merchandise off a vertical surface comprising;

a keeper having means for mounting onto the vertical surface, said keeper having a front face opposite said means for mounting and having a slotted keyway open at said front face, said keeper having a planar back surface, said planar back surface being adjacent said vertical surface when said keeper is mounted onto said vertical surface;

an outboard extension, for hanging merchandise, affixed to a base, said base forming a key complementary to said slotted keyway and said key being vertically insertable into said keyway such that said outboard extension extends outboard through said slot of said keyway, said base having a base portion defining an elongated, horizontally extending anti-rotation tab on its top surface such that after insertion of said key into said keyway, said tab which has a rear edge coplanar with said back surface, abuts said vertical surface and prevents upward rotation of said keeper, said base and said outboard extension; said extension rod, tab and base being a unitary structure.

2. A display hook system as claimed in claim 1 wherein said vertical surface is a pegboard surface, said means for mounting are pegboard insertion legs, said legs adapted to fit into and extend behind said pegboard surface.

3. A display hook system as claimed in claim 2 wherein said outboard extension is a pair of vertically spaced apart upper and lower extension rods joined to said base at their inboard ends, said upper and lower extension rods extending outboard through said slot of said keyway.

4. A display hook system as claimed in claim 3 wherein said legs extend outboard from said planar back surface of said keeper away from said slotted keyway and said legs define a smooth, 90° upward curve with respect to said keeper.

5. A display hook system as claimed in claim 3 wherein said slotted keyway is a vertical keyway that is T-shaped extending the height of the keeper.

6. A display hook system as claimed in claim 5 wherein the base leg portion of said T-shaped keyway forms a front end slot for said extension rods.

7. A display hook system as claimed in claim 6 wherein said key formed by said base includes an outboard base extension that fits into said front end slot, said outboard base extension having top and bottom regions respectively adjoining said upper and lower extension rods at their inboard regions.

8. A display hook system as claimed in claim 7 wherein said keeper has a flat top surface and said base has a top cap that abuts said keeper top surface when said base is inserted into said keeper.

9. A display hook system as claimed in claim 8 wherein said anti-rotation tab is part of said top cap of said base and extends away from said rods, over said keeper top surface and abuts said pegboard surface when said base is inserted into said keeper.

10. A display hook system as claimed in claim 9 wherein said legs extend outboard from said planar back surface of said keeper away from said slotted keyway and said legs define a smooth, 90° upward curve with respect to said keeper.

11. A display hook system as claimed in claim 10 wherein said legs are disposed on opposing sides of said keyway formed by said keeper.

12. A display hook system as claimed in claim 11 wherein said upper extension rod is longer than said lower extension rod and said upper rod carries, at an end remote from said base, a planar display surface.

13. A display hook system as claimed in claim 11 wherein said display surface is normal to the axial centerline of said upper rod and is sized such that an imaginary line coaxial with the axial centerline of said lower rod passes through said display surface.

14. A display hook system as claimed in claim 1 wherein said outboard extension is a single bar for hanging merchandise thereon.

15. A display hook system as claimed in claim 1 wherein said vertical surface is a slat wall with horizontal slat openings therein, said means for mounting is a curved lip that extends into a slat opening and behind said slat wall, said curved lip defines a smooth, 90° upward curve with respect to said keeper.

16. A display hook system as claimed in claim 15 wherein said slotted keyway is a vertical, T-shaped keyway extending the height of the keeper.

17. A display hook system as claimed in claim 15 wherein the base leg portion of said T-shaped keyway forms a front end slot for said outboard extension.

18. A display hook system as claimed in claim 17 wherein said key formed by said base includes an outboard base extension that fits into said front end slot, said outboard base extension adjoining said outboard extension that holds said merchandise.

19. A display hook system as claimed in claim 18 wherein said keeper has a flat top surface and said base has a top cap that abuts said keeper top surface when said base is inserted into said keeper.

20. A display hook system as claimed in claim 19 wherein said anti-rotation tab is part of said top cap of said base and extends away from said outboard extension for said merchandise, over said keeper top surface and abuts said slat wall surface when said base is inserted into said keeper.

21. A display hook system as claimed in claim 1 wherein said outboard extension, base and anti-rotation tab are integral and are made of plastic.

22. A display hook system as claimed in claim 13 wherein said rods, display surface, outboard base extension, base and key are integral and are made of plastic.

23. A method for hanging merchandise off a pegboard comprising the steps of:

providing a keeper with a T-shaped slotted front end keyway having a leg portion of said T-shape open opposite and away from said pegboard, and at least one extension rod having at its rear end a T-shaped key complementary with said T-shaped keyway; said T-shaped key having a top cap larger than said T-shaped key and keyway and having a vertical abutment surface opposite said rod;

vertically sliding the key through and into said keyway while sliding said vertical abutment surface of said top cap over said pegboard such that said rod extends out through said slotted keyway;

closely encasing said T-shaped key within said T-shaped keyway; and, preventing upward arcuate motion of said rod and said keeper relative to said pegboard both when said key is fully inserted into said keeper by abutment of said vertical abutment surface against said pegboard and during insertion of said key into said keyway.

24. A method as claimed in claim 23 wherein prevention of arcuate motion includes the step of the key bearing against said pegboard above said keeper.

25. A display hook system for hanging merchandise off a vertical surface comprising;

a keeper having means for mounting onto the vertical surface, said keeper having a front face opposite said means for mounting and having a slotted T-shaped keyway open at said front face, said keeper having a planar back surface, said planar back surface being adjacent said vertical surface when said keeper is mounted onto said vertical surface, said keeper also having a generally flat, top surface, said slotted T-shaped keyway also open at said keeper top surface thereby exposing said T-shaped keyway in said keeper;

an outboard extension, for hanging merchandise, affixed to a base, said base forming a T-shaped key complementary to said T-shaped keyway and said T-shaped key being vertically insertable into and being closely encased laterally and longitudinally within said T-shaped keyway such that said outboard extension extends longitudinally outboard through a longitudinal leg of said T-shaped keyway, said base having an anti-rotation tab on its top surface that extends laterally and longitudinally over said keeper top surface and said T-shaped keyway such that during and after abuts said vertical surface and prevents upward rotation of said keeper, said base and said outboard extension.

* * * * *